US012662951B2

(12) United States Patent
Yamakawa et al.

(10) Patent No.: US 12,662,951 B2
(45) Date of Patent: Jun. 23, 2026

(54) VALVE OPEN AND CLOSE PERIOD CONTROL DEVICE

(71) Applicant: AISIN CORPORATION, Kariya (JP)

(72) Inventors: Yoshiaki Yamakawa, Kariya (JP); Shoichi Yoshino, Kariya (JP); Atsushi Nishigaki, Kariya (JP); Kenji Ikeda, Kariya (JP); Yuki Nishida, Kariya (JP)

(73) Assignee: AISIN CORPORATION, Kariya (JP)

( * ) Notice: Subject to any disclaimer, the term of this patent is extended or adjusted under 35 U.S.C. 154(b) by 0 days.

(21) Appl. No.: 18/993,364

(22) PCT Filed: Aug. 25, 2023

(86) PCT No.: PCT/JP2023/030681
§ 371 (c)(1),
(2) Date: Jan. 10, 2025

(87) PCT Pub. No.: WO2024/070373
PCT Pub. Date: Apr. 4, 2024

(65) Prior Publication Data

US 2026/0028922 A1 Jan. 29, 2026

(30) Foreign Application Priority Data

Sep. 29, 2022 (JP) ..... 2022-156668

(51) Int. Cl.
*F01L 1/344* (2006.01)
*F01L 1/352* (2006.01)

(52) U.S. Cl.
CPC ..... *F01L 1/344* (2013.01); *F01L 1/352* (2013.01); *F01L 2810/02* (2013.01)

(58) Field of Classification Search
CPC ..... F01L 1/344; F01L 1/352; F01L 2810/02; F02D 13/0219; F16D 3/04; F16H 35/008;
(Continued)

(56) References Cited

U.S. PATENT DOCUMENTS

2019/0292952 A1 9/2019 Miyachi et al.

FOREIGN PATENT DOCUMENTS

| | | | |
|---|---|---|---|
| EP | 3767084 A1 | | 1/2021 |
| JP | 2014074388 A | * | 4/2014 |
| JP | 2018087564 A | | 6/2018 |

OTHER PUBLICATIONS

International Search Report (PCT/ISA/210) with translation and Written Opinion (PCT/ISA/237) mailed Nov. 14, 2023, by the Japan Patent Office as the International Searching Authority for International Application No. PCT/JP2023/030681. (9 pages).

(Continued)

*Primary Examiner* — Loren C Edwards
(74) *Attorney, Agent, or Firm* — BUCHANAN INGERSOLL & ROONEY PC

(57) ABSTRACT

A valve open and close period control device includes: a driving-side rotor that rotates synchronously with a crankshaft of an internal combustion engine; a driven-side rotor that rotates integrally with a camshaft of the engine; and a phase adjustment mechanism that sets a relative rotation phase between the driving-side rotor and the driven-side rotor. The driven-side rotor has a support wall portion connected to an end portion of the camshaft, and the support wall portion has an oil supply passage through which lubricating oil can be supplied from an outside to an inside of the driven-side rotor. The device has an oil reservoir structure that reduces a discharge amount of the lubricating oil discharged from an inside of the driving-side rotor, as compared to a supply amount of the lubricating oil supplied from the oil supply passage to the inside of the driven-side rotor when the driving-side rotor is rotating.

9 Claims, 6 Drawing Sheets

(58) Field of Classification Search
CPC ..... F16H 1/32; F16H 2001/327; F01M 9/10; F01M 9/108
See application file for complete search history.

(56) References Cited

OTHER PUBLICATIONS

Extended European Search Report issued on Dec. 15, 2025, in corresponding European Patent Application No. 23871614.6. (10 pages).

* cited by examiner

VALVE OPEN AND CLOSE PERIOD CONTROL DEVICE

TECHNICAL FIELD

The present disclosure relates to a valve open and close period control device.

BACKGROUND ART

Conventionally, in an internal combustion engine, there is used a valve open and close period control device that controls an open and close period of a valve by a cam portion of a camshaft through torque transmission from a crankshaft. As such a valve open and close period control device, for example, there is a valve opening/closing timing control device described in Patent Literature 1, the source of which is described below.

Patent Literature 1 describes a valve opening/closing timing control device. This valve opening/closing timing control device includes a driving-side rotor, a driven-side rotor, and a phase adjustment mechanism that sets a relative rotation phase between the driving-side rotor and the driven-side rotor. The phase adjustment mechanism includes an output gear provided on the driven-side rotor coaxially with a rotational axis center, an input gear that is connected to the driving-side rotor and rotates about an eccentric axis center that is in an orientation parallel to the rotational axis center, a first bearing, a second bearing, an eccentric member that has a tubular shape, and supports the input gear from an inner peripheral side via the second bearing and rotates the input gear, and the like.

CITATIONS LIST

Patent Literature

Patent Literature 1: JP 2018-087564 A

SUMMARY

Technical Problems

In a valve open and close period control device, generally, lubricating oil is supplied to an inside of a driven-side rotor during operation of an internal combustion engine. In the valve opening/closing timing control device described in Patent Literature 1, the driving-side rotor has a front plate on a side opposite to the camshaft with respect to the eccentric member, in a direction along the rotational axis center. This front plate has a circular shape as viewed in a direction along the rotational axis center, and has a circular opening at a center. This opening is provided to discharge lubricating oil in an internal space of the eccentric member to an outside. However, when the lubricating oil is excessively discharged to the outside during operation of the internal combustion engine, components included in the valve opening/closing timing control device come into contact with (collide with) each other, contact sound (collision sound) is generated, and noise and vibration generated from the valve opening/closing timing control device may increase.

Therefore, a valve open and close period control device capable of reducing noise and vibration during operation of an internal combustion engine is required.

Solutions to Problems

A valve open and close period control device according to the present disclosure has a characteristic configuration of including: a driving-side rotor that rotates synchronously with a crankshaft of an internal combustion engine about a rotational axis center; a driven-side rotor that is disposed coaxially with the rotational axis center on an inner side of the driving-side rotor, and rotates integrally with a camshaft for valve opening and closing of the internal combustion engine; and a phase adjustment mechanism that sets a relative rotation phase between the driving-side rotor and the driven-side rotor. The phase adjustment mechanism includes: an output gear provided on the driven-side rotor coaxially with the rotational axis center; an input gear that is connected to the driving-side rotor and rotates about an eccentric axis center that is in an orientation parallel to the rotational axis center; and an eccentric member that has a tubular shape, supports the input gear from an inner peripheral side via a support bearing, and rotates the input gear. The eccentric member is configured to rotate to revolve the eccentric axis center to change a position of a meshing portion between the output gear and the input gear, the driven-side rotor has a support wall portion connected to an end portion of the camshaft in an orientation orthogonal to the rotational axis center, the support wall portion has an oil supply passage through which lubricating oil can be supplied from an outside to an inside of the driven-side rotor, and the driving-side rotor has a front plate on a side opposite to the camshaft with respect to the eccentric member in a direction along the rotational axis center. The valve open and close period control device has an oil reservoir structure that reduces a discharge amount of the lubricating oil discharged from an inside of the driving-side rotor, as compared to a supply amount of the lubricating oil supplied from the oil supply passage to the inside of the driven-side rotor when the driving-side rotor is rotating.

With such a characteristic configuration, when the driving-side rotor is rotating, the lubricating oil supplied from the oil supply passage to the inside of the driven-side rotor can be made difficult to be discharged from the inside of the driving-side rotor, so that oil (lubricating oil) can be stored in the driving-side rotor. By storing the lubricating oil in the driving-side rotor in this manner, it is possible to reduce loudness of sound caused by contact or collision of individual portions, with an oil damping effect. Therefore, noise and vibration generated from the valve open and close period control device can be suppressed.

DESCRIPTION OF EMBODIMENTS

Hereinafter, embodiments of the present disclosure will be described with reference to the drawings.

[Basic Configuration]

Figure 1:
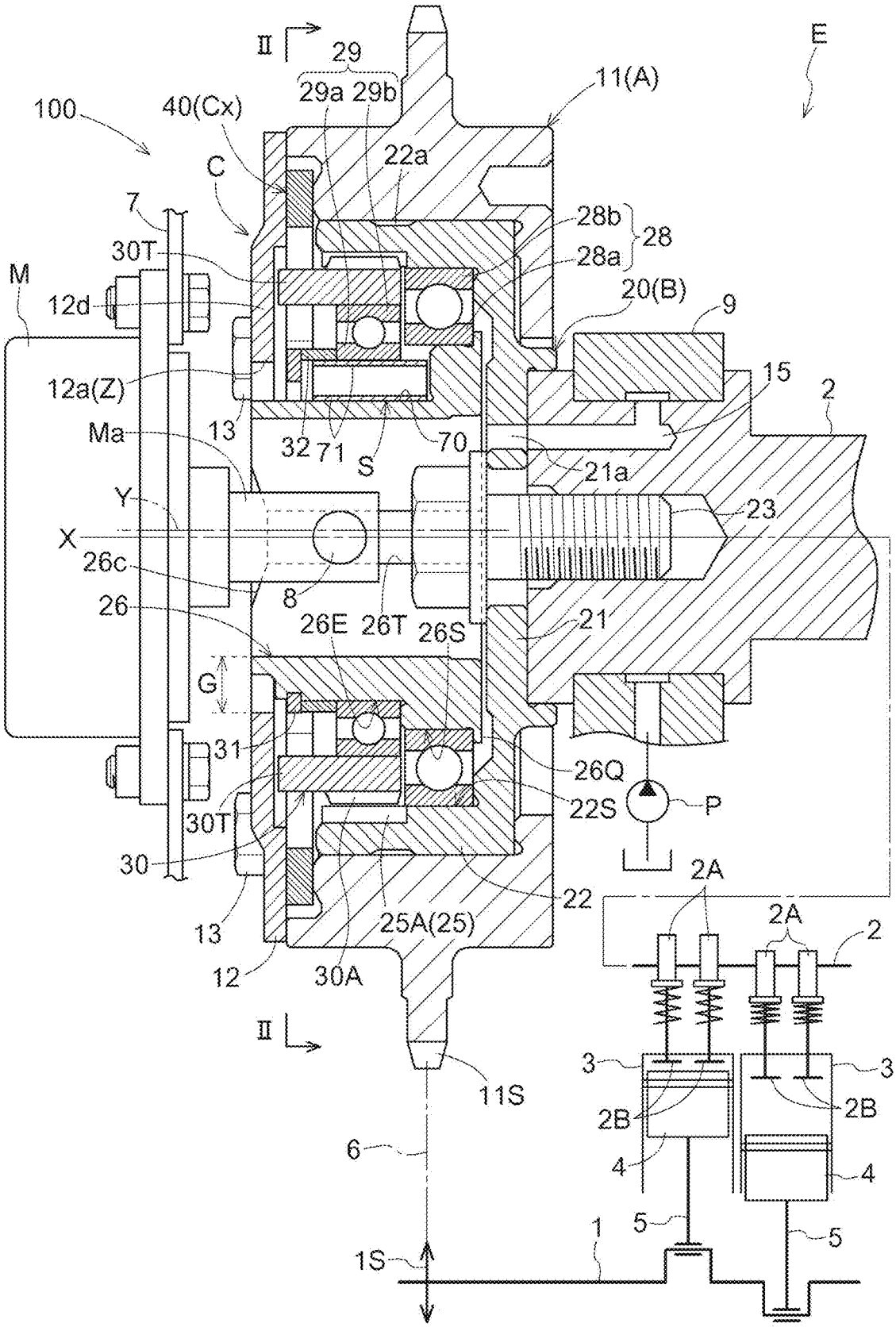
FIG. 1 is a cross-sectional view of a valve open and close period control device.

As illustrated in FIG. 1, a valve open and close period control device 100 according to the present embodiment includes a driving-side rotor A, a driven-side rotor B, and a phase adjustment mechanism C. The driving-side rotor A rotates about a rotational axis center X in synchronization with a crankshaft 1 of an engine E as an internal combustion engine. The driven-side rotor B is disposed inside the driving-side rotor A coaxially with the rotational axis center X. Further, the driven-side rotor B rotates integrally with an intake camshaft 2 (an example of a camshaft) that opens and closes an intake valve 2B (an example of a valve) of the engine E. The phase adjustment mechanism C sets a relative rotation phase between the driving-side rotor A and the driven-side rotor B by using a driving force of a phase control motor M.

The engine E is a four-cycle engine in which pistons 4 are accommodated in a plurality of cylinders 3 formed in a cylinder block, and the pistons 4 are connected to the crankshaft 1 by connecting rods 5. A timing chain 6 (which may be a timing belt or the like) is wound around an output sprocket 1S of the crankshaft 1 of the engine E and a drive sprocket 11S of the driving-side rotor A.

As a result, the entire valve open and close period control device 100 rotates about the rotational axis center X during operation of the engine E. In addition, the phase adjustment mechanism C is operated by a driving force of the phase control motor M, and the driven-side rotor B can be displaced with respect to the driving-side rotor A in a direction same as or opposite to the rotation direction. The relative rotation phase between the driving-side rotor A and the driven-side rotor B is set by displacement in the phase adjustment mechanism C, and the control of an open and close period (open and close timing) of the intake valve 2B by a cam portion 2A of the intake camshaft 2 is achieved.

Note that, an operation in which the driven-side rotor B is relatively displaced in the same direction as the rotation direction of the driving-side rotor A is referred to as an advance operation, and an intake compression ratio is increased by this advance operation. In addition, an operation in which the driven-side rotor B is relatively displaced in a direction opposite to the driving-side rotor A (operation in a direction opposite to the advance operation) is referred to as a retard operation, and the intake compression ratio is reduced by this retard operation.

[Valve Open and Close Period Control Device]

As illustrated in FIG. 1, the driving-side rotor A is configured by fastening, with a plurality of fastening bolts 13, an outer case 11 having the drive sprocket 11S formed on an outer periphery thereof, and a front plate 12. The outer case 11 has a bottomed tubular shape having an opening at a bottom portion. The front plate 12 is provided on a side opposite to the intake camshaft 2 with respect to an eccentric member 26, in a direction along the rotational axis center X.

Figure 2:
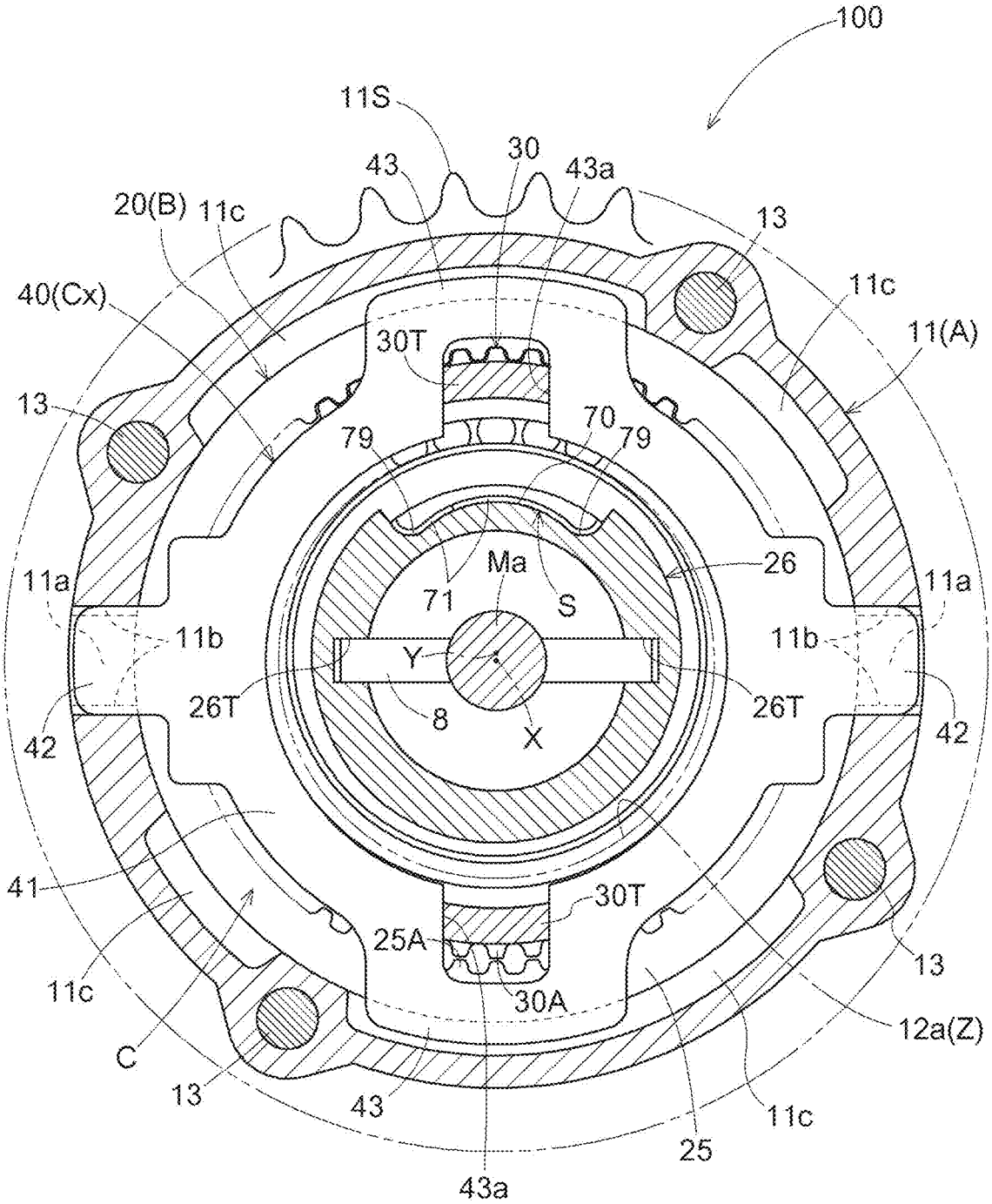
FIG. 2 is a cross-sectional view taken along line II-II in FIG. 1.

As illustrated in FIGS. 1 and 2, an internal space of the outer case 11 accommodates an intermediate member 20 as the driven-side rotor B, and the phase adjustment mechanism C having a hypotrochoid-type gear reduction mechanism. In addition, the phase adjustment mechanism C includes an Oldham's coupling Cx that reflects a phase change on the driving-side rotor A and the driven-side rotor B.

The intermediate member 20 included in the driven-side rotor B is integrally formed with a support wall portion 21 connected to the intake camshaft 2 in an orientation orthogonal to the rotational axis center X, and a tubular wall portion 22 having a tubular shape centered on the rotational axis center X and protruding from an outer peripheral edge of the support wall portion 21 in a direction away from the intake camshaft 2.

This intermediate member 20 is fitted in a relatively rotatable manner in a state where an outer surface of the tubular wall portion 22 is in contact with an inner surface of the outer case 11, and the intermediate member 20 is fixed to an end portion of the intake camshaft 2 by a connecting bolt 23 inserted into a through hole at a center of the support wall portion 21. In this fixed state, an end portion on an outer side (side farther from the intake camshaft 2) of the tubular wall portion 22 is located on an inner side of the front plate 12.

As illustrated in FIGS. 1 and 2, a groove 22*a* is formed over the entire periphery on the outer peripheral side of the tubular wall portion 22. The groove 22*a* improves retention of lubricating oil between the outer surface of the tubular wall portion 22 and the inner surface of the outer case 11. As a result, a frictional force between the tubular wall portion 22 and the outer case 11 is reduced, and the intermediate member 20 smoothly rotates with respect to the outer case 11.

As illustrated in FIG. 1, the phase control motor M is supported by the engine E with a support frame 7 such that an output shaft Ma of the phase control motor M is disposed coaxially with the rotational axis center X. On the output shaft Ma of the phase control motor M, a pair of engaging pins 8 are formed in an orientation orthogonal to the rotational axis center X.

[Phase Adjustment Mechanism]

Figure 3:
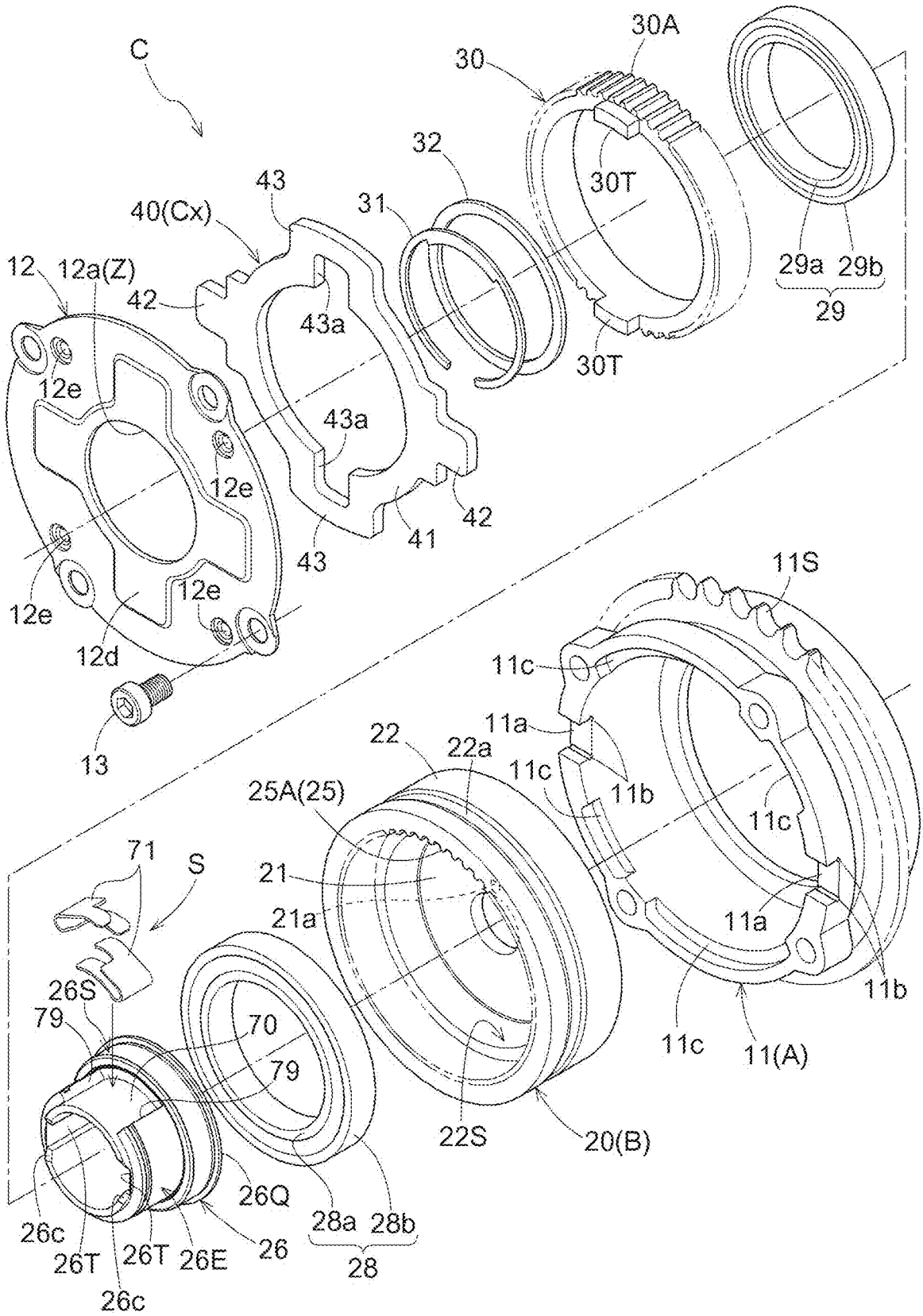
FIG. 3 is an exploded perspective view of the valve open and close period control device.

As illustrated in FIGS. 1 to 3, the phase adjustment mechanism C includes the intermediate member 20, an output gear 25 formed on an inner peripheral surface of the tubular wall portion 22 of the intermediate member 20, the eccentric member 26, an elastic member S, a first bearing 28, a second bearing 29 (corresponding to a "support bearing"), an input gear 30, a fixing ring 31, a ring-shaped spacer 32, and the Oldham's coupling Cx. Note that a rolling bearing is used for the first bearing 28 and the second bearing 29, but a sliding bearing can also be used. In the present embodiment, the first bearing 28 is a ball bearing having an inner ring 28*a* in contact with an outer peripheral surface of the eccentric member 26 and an outer ring 28*b* in contact with an inner peripheral surface of the intermediate member 20. Further, the second bearing 29 is a ball bearing having an inner ring 29*a* in contact with the outer peripheral surface of the eccentric member 26 and an outer ring 29*b* in contact with an inner peripheral surface of the input gear 30.

As illustrated in FIG. 1, in an inner periphery of the tubular wall portion 22 of the intermediate member 20, a support surface 22S centered on the rotational axis center X is formed on the inner side (at a position adjacent to the support wall portion 21) in a direction (hereinafter, described as an axial direction) along the rotational axis center X, and the output gear 25 centered on the rotational axis center X is integrally formed on the outer side (side farther from the intake camshaft 2) of the support surface 22S.

As illustrated in FIGS. 1 to 3, the eccentric member 26 has a tubular shape. In the eccentric member 26, a circumference support surface 26S of the outer peripheral surface centered on the rotational axis center X is formed on the inner side (side closer to the intake camshaft 2) in the axial direction. On a further inner side (side further closer to the intake camshaft 2) in the axial direction of the circumference support surface 26S, a flange portion 26Q protruding further radially outward from the circumference support surface 26S is formed. Further, the eccentric member 26 has an eccentric support surface 26E formed on the outer peripheral surface centered on an eccentric axis center Y that is eccentric in an orientation parallel to the rotational axis center X on the outer side (side farther from the intake camshaft 2). Therefore, the eccentric member 26 is formed by arranging the flange portion 26Q, the circumference support surface 26S, and the eccentric support surface 26E in this order along the axial direction from the side closer to the intake camshaft 2. Since a direction along the eccentric axis center Y is the same as the axial direction, hereinafter, the direction along the eccentric axis center Y is also simply referred to as the axial direction.

As illustrated in FIGS. 1 and 3, the eccentric support surface 26E is formed with a first recess 70 that is recessed inward along the radial direction of the eccentric member 26. On a bottom surface of the first recess 70, a pair of second recesses 79 and 79 recessed toward the radial axis side of the eccentric member 26 are formed at both ends in a peripheral direction of the eccentric member 26. In the present embodiment, the first recess 70 is symmetrical in the peripheral direction.

Each of the second recesses 79 and 79 is formed at each end portion of the first recess 70 in the peripheral direction of the eccentric member 26. A maximum depth of bottom surfaces of the second recesses 79 and 79 in the radial direction of the eccentric member 26 is deeper than a depth of the bottom surface of the first recess 70 near a peripheral center of the eccentric member 26. A surface from the bottom surface to the end portion of each of the second recesses 79 and 79 in the peripheral direction of the eccentric member 26 is formed in a shape along a curved shape of a spring member 71 described later.

The elastic member S is fitted into the first recess 70. The elastic member S includes a pair of spring members 71 and 71. In the present embodiment, the pair of spring members 71 and 71 each have the same shape and the same size. The elastic member S applies a biasing force to the input gear 30 via the second bearing 29 such that a part of an external tooth portion 30A of the input gear 30 meshes with a part of an internal tooth portion 25A of the output gear 25. As a result, it is possible to prevent expansion of backlash between the input gear 30 and the output gear 25, and to prevent abnormal noise. Further, as a result, durability of the input gear 30 and the output gear 25 can be improved.

As illustrated in FIGS. 1 and 3, on an inner periphery of the eccentric member 26, a pair of engaging grooves 26T with which the pair of engaging pins 8 of the phase control motor M (see FIG. 1) can be individually engaged are formed in an orientation parallel to the rotational axis center X.

As illustrated in FIG. 3, on an inner peripheral side at an opening end on the outer side (side farther from the intake camshaft 2) of the eccentric member 26, tapered portions 26*c* (inclined portions) having a diameter decreasing toward the inner side (side closer to the intake camshaft 2) are formed on both side portions of the engaging grooves 26T. When the pair of engaging pins 8 of the phase control motor M are engaged with the engaging grooves 26T of the eccentric member 26, the engaging pins 8 are guided to the engaging grooves 26T by the tapered portions 26*c*, so that engagement work between the phase control motor M and the eccentric member 26 is facilitated.

As illustrated in FIG. 1, this eccentric member 26 is supported rotatably about the rotational axis center X with respect to the intermediate member 20 by externally fitting the first bearing 28 to the circumference support surface 26S and fitting the first bearing 28 into the support surface 22S of the tubular wall portion 22. Further, as illustrated in FIG. 1, the input gear 30 is rotatably supported about the eccentric axis center Y with on the eccentric support surface 26E of the eccentric member 26 via the second bearing 29.

In this phase adjustment mechanism C, the number of teeth of the external tooth portion 30A of the input gear 30 is set to be smaller than the number of teeth of the internal tooth portion 25A of the output gear 25 by one tooth. A part of the external tooth portion 30A of the input gear 30 meshes with a part of the internal tooth portion 25A of the output gear 25.

As illustrated in FIG. 1, the fixing ring 31 is supported by an outer periphery of the eccentric member 26 in a fitted state to prevent the second bearing 29 from coming off via the spacer 32.

As illustrated in FIG. 1, a gap is formed between the eccentric member 26 and the support wall portion 21 of the intermediate member 20.

[Phase Adjustment Mechanism: Oldham's Coupling]

As illustrated in FIGS. 1 to 3, the Oldham's coupling Cx includes a plate-shaped coupling member 40 integrally formed with a central annular portion 41, a pair of external engagement arms 42 protruding radially outward from this annular portion 41 along a first direction (left-right direction in FIG. 2), and an internal engagement arm 43 protruding radially outward from the annular portion 41 along a second direction (up-down direction in FIG. 2) orthogonal to the first direction. Each of a pair of internal engagement arms 43 is provided with an engaging recess 43*a* continuous with an opening of the annular portion 41.

In the outer case 11, in an opening edge portion with which the front plate 12 comes into contact, there are formed a pair of guide grooves 11*a* having a penetrating groove shape and extending in the radial direction about the rotational axis center X from the internal space to an external space of the outer case 11. A groove width of this guide groove 11*a* is set to be slightly wider than a width of the external engagement arm 42, and cut portions 42*a* notched obliquely are formed at both peripheral end portions of the external engagement arm 42. At each of the guide grooves 11*a* and the cut portions 42*a* at the both peripheral end portions of the external engagement arm 42, a pair of discharge flow paths 11*b* are formed by notching.

At the opening edge portion of the outer case 11, one or more pockets 11*c* whose inner peripheral side is notched along the peripheral direction are formed in a portion other than the guide groove 11*a*. The pocket 11*c* corrects foreign matters that move to the outer peripheral side by receiving a centrifugal force caused by rotation of the driving-side rotor A. FIGS. 2 and 3 illustrate a case where four pockets 11*c* are formed.

Further, a pair of engaging protrusions 30T are integrally formed on an end surface of the input gear 30 facing the front plate 12. An engagement width of this engaging protrusion 30T is set to be slightly narrower than an engagement width of the engaging recess 43*a* of the internal engagement arm 43.

With such a configuration, it is possible to cause the Oldham's coupling Cx to function by engaging the pair of external engagement arms 42 of the coupling member 40 with the pair of guide grooves 11*a* of the outer case 11, and engaging the pair of engaging protrusions 30T of the input gear 30 with the engaging recesses 43*a* of the pair of internal engagement arms 43 of the coupling member 40.

Note that, the coupling member 40 can be displaced in the first direction (the left-right direction in FIG. 2) in which the external engagement arm 42 extends with respect to the outer case 11, and the input gear 30 can be displaced in the second direction (the up-down direction in FIG. 2) along the forming direction of the engaging recess 43*a* of the internal engagement arm 43, with respect to the coupling member 40.

As illustrated in FIGS. 1 and 3, the spacer 32 makes a distance of a gap in which the second bearing 29 can move in the axial direction equal to or less than a predetermined set value. Since the spacer 32 is provided between the Oldham's coupling Cx (coupling member 40) and the second bearing 29, the movement of the second bearing 29 in the axial direction is limited to a distance equal to or less than the predetermined set value. Further, on a surface of the front plate 12 facing the input gear 30, a recess 12*d* recessed toward the outer side (side farther from the intake camshaft 2) is formed. The recess 12*d* is provided to face an opening portion of the coupling member 40 in the front plate 12, and the recess 12*d* is formed to be slightly wider than the opening portion of the coupling member 40. Accordingly, contact between the engaging protrusion 30T of the input gear 30 and the front plate 12 can be prevented.

[Arrangement of Individual Portions of Valve Open and Close Period Control Device]

In the valve open and close period control device 100 in an assembled state, as illustrated in FIG. 1, the support wall portion 21 of the intermediate member 20 is connected to the end portion of the intake camshaft 2 by the connecting bolt 23, and these components rotate integrally. The eccentric member 26 is supported by the first bearing 28 so as to be relatively rotatable about the rotational axis center X with respect to the intermediate member 20. As illustrated in FIG. 1, the input gear 30 is supported on the eccentric support surface 26E of the eccentric member 26 via the second bearing 29, and a part of the external tooth portion 30A of the input gear 30 meshes with a part of the internal tooth portion 25A of the output gear 25.

Further, as illustrated in FIG. 2, the external engagement arms 42 of the Oldham's coupling Cx are engaged with the pair of guide grooves 11*a* of the outer case 11, and the engaging protrusion 30T of the input gear 30 is engaged with the engaging recess 43*a* of the internal engagement arm 43 of the Oldham's coupling Cx. As illustrated in FIG. 1, since the front plate 12 is disposed on the outer side of the coupling member 40 of the Oldham's coupling Cx, the coupling member 40 is movable in a direction orthogonal to the rotational axis center X in a state of being in contact with the inner surface of the front plate 12. With this arrangement, the Oldham's coupling Cx is disposed on the outer side of both the first bearing 28 and the second bearing 29 (side farther from the intake camshaft 2) and on the inner side of the front plate 12 (side closer to the intake camshaft 2).

As illustrated in FIG. 1, the pair of engaging pins 8 formed on the output shaft Ma of the phase control motor M are engaged with the engaging grooves 26T of the eccentric member 26.

[Operation Mode of Phase Adjustment Mechanism]

Although not illustrated in the drawings, the phase control motor M is controlled by a control device configured as an ECU. The engine E includes sensors capable of detecting rotation speeds (the number of rotations per unit time) of the crankshaft 1 and the intake camshaft 2 and the rotation phases of the crankshaft 1 and the intake camshaft 2. The engine E is configured such that detection signals of these sensors are input to the control device.

The control device maintains a relative rotation phase by driving the phase control motor M at a speed equal to a rotational speed of the intake camshaft 2 when the engine E is in operation. On the other hand, the advance operation is performed by reducing the rotational speed of the phase control motor M to be lower than the rotational speed of the intake camshaft 2, and conversely, the retard operation is performed by increasing the rotational speed. As described above, an intake compression ratio is increased by the advance operation, and the intake compression ratio is reduced by the retard operation.

When the phase control motor M rotates with the outer case 11 at a constant speed (constant speed with the intake camshaft 2), a position of a meshing portion of the external tooth portion 30A of the input gear 30 with respect to the internal tooth portion 25A of the output gear 25 does not change, so that the relative rotation phase of the driven-side rotor B with respect to the driving-side rotor A is maintained.

On the other hand, by driving and rotating the output shaft Ma of the phase control motor M at a speed higher or lower than a rotation speed of the outer case 11, the eccentric axis center Y revolves around the rotational axis center X in the phase adjustment mechanism C. Due to this revolution, the position of the meshing portion of the external tooth portion 30A of the input gear 30 with respect to the internal tooth portion 25A of the output gear 25 is displaced along an inner periphery of the output gear 25, and a rotational force acts between the input gear 30 and the output gear 25. That is, the rotational force about the rotational axis center X acts on the output gear 25, and the rotational force to rotate about the eccentric axis center Y acts on the input gear 30.

As described above, since the engaging protrusion 30T of the input gear 30 is engaged with the engaging recess 43*a* of the internal engagement arm 43 of the coupling member 40, the input gear 30 does not rotate with respect to the outer case 11, and the rotational force acts on the output gear 25. By the action of the rotational force, the intermediate member 20 together with the output gear 25 rotates about the rotational axis center X with respect to the outer case 11. As a result, the relative rotation phase between the driving-side rotor A and the driven-side rotor B is set, and the open and close period by the intake camshaft 2 is set.

Further, when the eccentric axis center Y of the input gear 30 revolves about the rotational axis center X, with the displacement of the input gear 30, the coupling member 40 of the Oldham's coupling Cx is displaced in the direction (first direction) in which the external engagement arm 42 extends with respect to the outer case 11, and the input gear 30 is displaced in the direction (second direction) in which the internal engagement arm 43 extends.

As described above, since the number of teeth of the external tooth portion 30A of the input gear 30 is set to be smaller than the number of teeth of the internal tooth portion 25A of the output gear 25 by one tooth, in a case where the eccentric axis center Y of the input gear 30 revolves by one rotation around the rotational axis center X, the output gear 25 rotates by one tooth, and large deceleration is achieved.

[Lubrication of Phase Adjustment Mechanism]

As illustrated in FIG. 1, the intake camshaft 2 is formed with a lubricating oil passage 15 through which lubricating oil from an external oil pump P is supplied via an oil passage forming member 9. On a part of a surface in contact with the intake camshaft 2 in the support wall portion 21 of the intermediate member 20, an oil supply passage 21*a* that guides the lubricating oil flowing through the lubricating oil passage 15 is formed inside the eccentric member 26. That is, the support wall portion 21 has the oil supply passage 21*a* through which the lubricating oil can be supplied from the outside to the inside of the driven-side rotor B.

As described above, a gap is formed between the eccentric member 26 and the support wall portion 21 of the intermediate member 20. The oil supply passage 21*a* communicates with this gap.

With this configuration, the lubricating oil supplied from the oil pump P is supplied from the lubricating oil passage 15 of the intake camshaft 2 to the internal space of the intermediate member 20, via the oil supply passage 21*a* of the support wall portion 21 of the intermediate member 20. A part of the lubricating oil supplied to the internal space of the intermediate member 20 flows through an internal space of the eccentric member 26, but a part of the lubricating oil is supplied to the first bearing 28 through the gap between the eccentric member 26 and the support wall portion 21 of the intermediate member 20 by a centrifugal force, to allow the first bearing 28 to smoothly operate (slide). The lubricating oil supplied to the first bearing 28 is then supplied to the adjacent second bearing 29 and is supplied between the internal tooth portion 25A of the output gear 25 and the external tooth portion 30A of the input gear 30, which are disposed on the outer peripheral side of the second bearing 29 and biased by the elastic member S, to allow these portions (in particular, the meshing portion) to smoothly operate (slide).

The lubricating oil supplied to the second bearing 29 and to between the internal tooth portion 25A of the output gear 25 and the external tooth portion 30A of the input gear 30 is further supplied to the coupling member 40. The lubricating oil supplied to the coupling member 40 is supplied between the front plate 12 and the coupling member 40, and is supplied to a gap between the external engagement arm 42 of the coupling member 40 and the guide groove 11*a* of the outer case 11. As a result, the coupling member 40 is operated smoothly.

As described above, the pair of discharge flow paths 11*b* are formed in the guide groove 11*a* (see FIGS. 2 and 3). Therefore, the lubricating oil supplied to the coupling member 40 is discharged to the outside from the gap between the external engagement arm 42 of the coupling member 40 and the guide groove 11*a* of the outer case 11. In addition, since the discharge flow path 11*b* is formed in the guide groove 11*a*, the lubricating oil inside can be discharged from the discharge flow path 11*b* by centrifugal force when the engine E is started.

As illustrated in FIGS. 1 and 3, the front plate 12 has a circular opening 12*a* centered on the rotational axis center X at the center. By making an opening diameter of the opening 12*a* larger than an inner diameter of the eccentric member 26, a step G is formed between an opening edge of the opening 12*a* of the front plate 12 and the inner periphery of the eccentric member 26. This step G is set to the minimum within a range in which the eccentric member 26 does come into contact with the front plate 12 when rotating.

When the engine E stops, the step G allows the lubricating oil in the internal space of the eccentric member 26 to be discharged from the opening 12*a* of the front plate 12, and an oil amount of the lubricating oil remaining inside can be reduced.

As described above, in the valve open and close period control device 100, the lubricating oil supplied to the inside of the driven-side rotor B can be discharged from the guide groove 11*a* of the outer case 11 and the opening 12*a* of the front plate 12.

Figure 4:
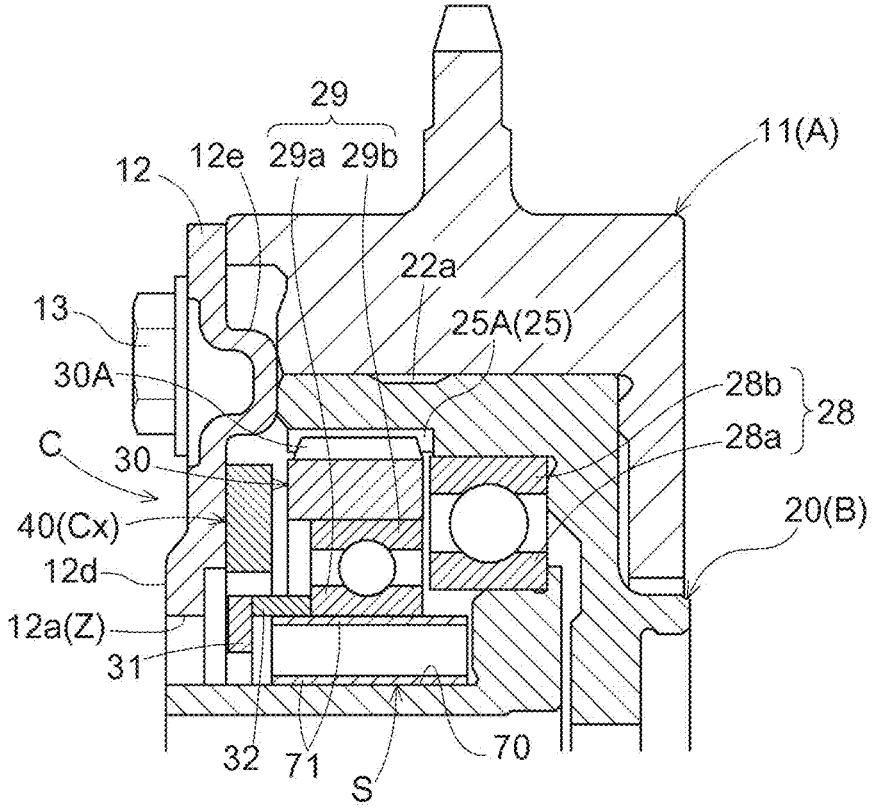
FIG. 4 is a view illustrating a protrusion of a front plate.

In the present embodiment, as illustrated in FIG. 3, on a surface of the front plate 12 facing the intermediate member 20, four protrusions 12*e* protruding inward (side closer to the intake camshaft 2) are formed along the peripheral direction of the front plate 12. As illustrated in FIG. 4, the protrusion 12*e* is provided along the axial direction so as to face a boundary between an inner peripheral surface of the outer case 11 and an outer peripheral surface of the intermediate member 20. As a result, the flow of the lubricating oil discharged from between the outer case 11 and the intermediate member 20 can be made different from the flow of the lubricating oil discharged from between the outer case 11 and the intermediate member 20 at a portion where the protrusion 12*e* is not provided, and the lubricating oil in the outer case 11 can be caused to flow.

Here, when the outer case 11 is rotating as described above, the lubricating oil is supplied from the oil supply passage 21*a* to the inside of the intermediate member 20. The valve open and close period control device 100 is configured to have an oil reservoir structure Z that reduces a discharge amount of the lubricating oil discharged from the inside of the outer case 11 as compared to a supply amount of the lubricating oil supplied from the oil supply passage 21*a* to the inside of the intermediate member 20, during the synchronous rotation. Hereinafter, the oil reservoir structure Z will be described.

As described above, the external engagement arm 42 of the coupling member 40 is engaged with the guide groove 11*a* of the outer case 11. This guide groove 11*a* is configured to be supplied with the lubricating oil in order to enhance lubricity between with the external engagement arm 42. However, since the lubricating oil having entered the guide groove 11*a* is discharged to the outside of the outer case 11 due to the structure, in the present embodiment, the amount of the lubricating oil discharged from the guide groove 11*a* is limited to a predetermined amount or less.

Figure 5:
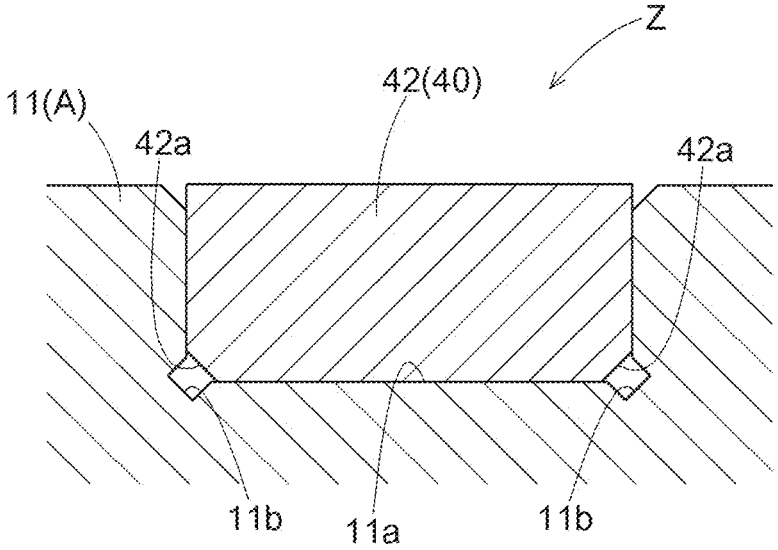
FIG. 5 is a view illustrating a discharge flow path.

Specifically, the lubricating oil in the guide groove 11*a* flows through the pair of discharge flow paths 11*b* formed by notching from the inside to the outside of the outer case 11 in each of the pair of guide grooves 11*a* as illustrated in FIG. 5. In the present embodiment, the oil reservoir structure Z is configured such that the oil amount of the lubricating oil discharged from the pair of discharge flow paths 11*b* is smaller than the oil amount of the lubricating oil flowing through the oil supply passage 21*a* when the outer case 11 rotates. As a result, it is possible to make it difficult for the lubricating oil supplied to the inside of the outer case 11 to be discharged, while having a lubricating function in the guide groove 11*a*.

Further, as illustrated in FIGS. 1 and 2, one side in the axial direction of the eccentric member 26 is inserted into the opening 12*a* which is an opening at a radially central portion of the front plate 12. In the present embodiment, the front plate 12 is opened up to a position of the inserted radially outer end portion in a state where the eccentric member 26 has the largest difference in the eccentric axis center Y with respect to the rotational axis center X, with the rotational axis center X as the center. In other words, the front plate 12 closes the opening portion of the outer case 11 up to the position of the inserted radially outer end portion in the state where the eccentric member 26 has the largest difference in the eccentric axis center Y with respect to the rotational axis center X, with the rotational axis center X as a center. That is, as described above, the eccentric axis center Y is eccentric with respect to the rotational axis center X, and the eccentric axis center Y revolves around the rotational axis center X. Therefore, the portion of the eccentric member 26 inserted through the front plate 12 rotates about the rotational axis center X with, as a rotation radius, a radius obtained by adding an amount of eccentricity of the eccentric axis center Y with respect to the rotational axis center X to half of an outer diameter of the portion of the eccentric member 26 inserted through the front plate 12. The opening 12*a* is configured such that the portion of the eccentric member 26 inserted into the front plate 12 has an inner radius that is a sum of a half of the outer diameter of the portion of the eccentric member 26 inserted into the front plate 12, and an amount of eccentricity of the eccentric axis center Y with respect to the rotational axis center X, so that the eccentric member 26 does not come into contact with the front plate 12 when rotating. In addition, an inner radius of the opening 12*a* is smaller than an inner radius of the coupling member 40, the coupling member 40 is covered by the front plate 12, and the coupling member 40 cannot be visually recognized from the outside. As a result, a configuration can be achieved in which the lubricating oil is stored from the inner peripheral surface of the outer case 11 to the opening 12*a* during operation of the engine E. Such a configuration of the opening 12*a* also corresponds to the oil reservoir structure Z described above.

Figure 6:
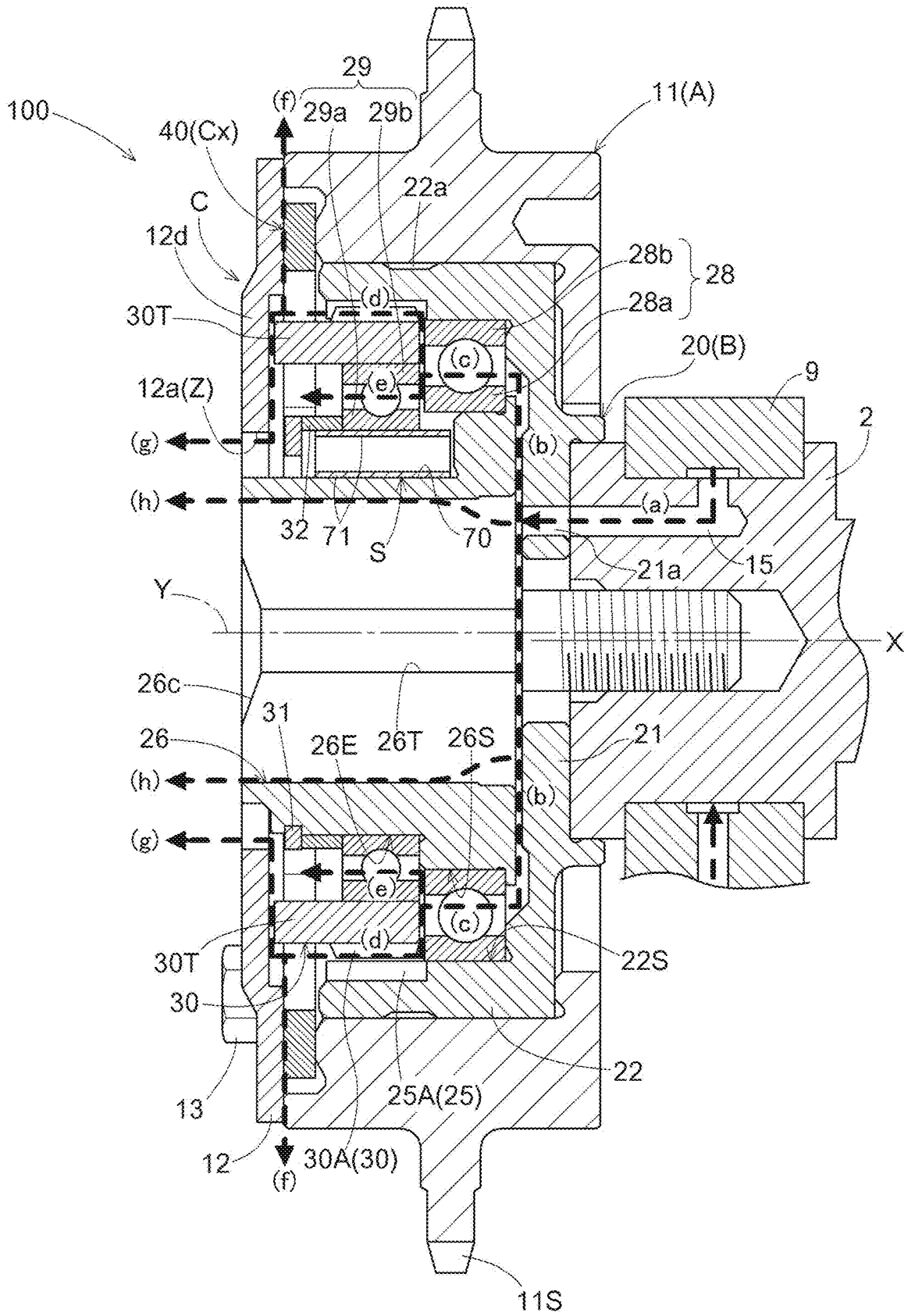
FIG. 6 is a view illustrating a flow of lubricating oil.

FIG. 6 illustrates a flow mode of the lubricating oil in the valve open and close period control device 100. In the valve open and close period control device 100, the lubricating oil is supplied from the oil pump P to the oil supply passage 21*a* via the lubricating oil passage 15 (a). When the outer case 11 is rotating, the lubricating oil supplied from the oil supply passage 21*a* to the inside of the intermediate member 20 flows between the inner peripheral surface of the intermediate member 20 and the outer peripheral surface of the eccentric member 26, and to the inside of the eccentric member 26. That is, most of the lubricating oil supplied to the oil supply passage 21*a* flows between the eccentric member 26 and the support wall portion 21 of the intermediate member 20 by a centrifugal force, and flows toward the first bearing 28 by a centrifugal force (b). Further, a part of the lubricating oil also flows (drops) to a central portion (radially central portion) of the eccentric member 26 (h).

The lubricating oil flowing through the first bearing 28 flows between the inner ring 28*a* and the outer ring 28*b* (c), and is supplied to between the intermediate member 20 and the input gear 30 (d) and to the second bearing 29 (e). The lubricating oil flowing between the intermediate member 20 and the input gear 30 and the lubricating oil supplied to the second bearing 29 and flowing between the inner ring 29*a* and the outer ring 29*b* are discharged to the outside of the outer case 11 through a gap between the front plate 12 and the outer case 11 (f), but most of the lubricating oil is stored inside the outer case 11.

When the second bearing 29 is viewed from a direction along the rotational axis center X, the front plate 12 covers a region where the lubricating oil flows between the inner peripheral surface of the intermediate member 20 and the outer peripheral surface of the eccentric member 26. That is, an inner peripheral surface of the opening 12*a* is provided at a position closer to the rotational axis center X than the portion (d) between the intermediate member 20 and the input gear 30 described above and the path (e) for supply to the second bearing 29. As a result, the lubricating oil is stored in the outer case 11 from the inner peripheral surface side of the outer case 11 by a centrifugal force, and the lubricating oil is discharged from the opening 12*a* after reaching the opening 12*a* (g).

Further, the pair of discharge flow paths 11*b* are configured such that a discharge amount of the lubricating oil from the pair of discharge flow paths 11*b* is smaller than a discharge amount of the lubricating oil flowing between the inner peripheral surface of the intermediate member 20 and the outer peripheral surface of the eccentric member 26. As a result, a flow amount in (a) of FIG. 6 is the sum of a flow amount in (c) and the flow amount in (h), and the flow amount in (f) is smaller than the flow amount in (c), so that the lubricating oil can be stored in the outer case 11 until the lubricating oil flows out along (g). That is, the lubricating oil flowing in (b) flows along (c), (d), and (e), is stored inside the outer case 11 due to a centrifugal force, and is discharged along (g) when a liquid level reaches the opening 12*a*. At this time, the flow amount in (b) is the sum of the flow amount in (f) and the flow amount in (g). That is, an oil amount of the lubricating oil discharged from the discharge flow path 11*b* is made smaller than an oil amount obtained by subtracting an oil amount of the lubricating oil flowing inside the eccentric member 26 from an oil amount of the lubricating oil flowing through the oil supply passage 21*a*.

As a result, since the lubricating oil can be stored inside during driving of the valve open and close period control device 100, it is possible to reduce loudness of sound caused by contact or collision of individual portions, with a damping effect of oil (lubricating oil). Therefore, noise and vibration generated from the valve open and close period control device 100 can be reduced (specifically, with the above configuration, it is possible to obtain a noise and vibration reduction effect in units of several dB). Further, when the valve open and close period control device 100 is not driven, the lubricating oil can be discharged from the opening 12*a* and the gap between the front plate 12 and the outer case 11. Therefore, for example, it is possible to suppress a decrease in a starting speed of the engine E (deterioration in starting performance of the engine E) due to viscosity of the lubricating oil at a low temperature.

[Other Embodiments]

Figure 7:
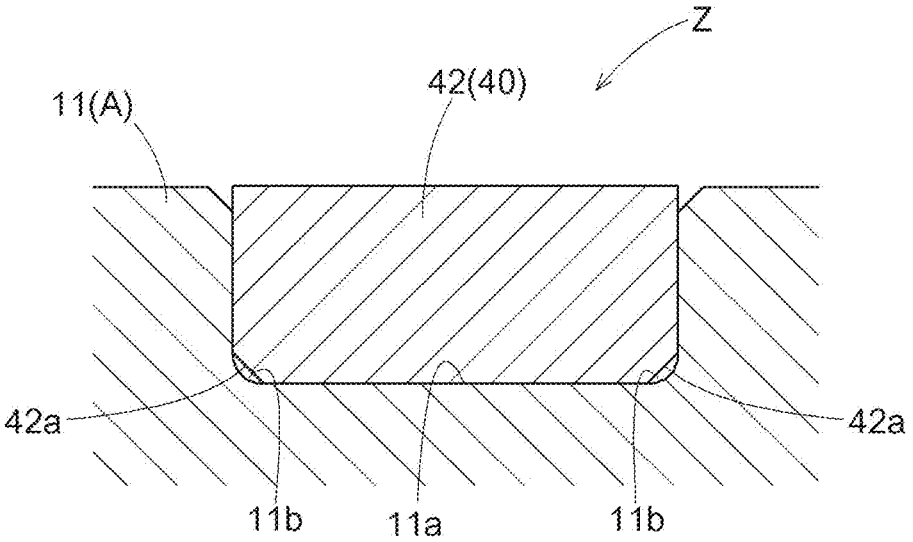
FIG. 7 is a view illustrating a discharge flow path according to another embodiment.

In the embodiment described above, as the oil reservoir structure Z, it has been described that the discharge flow path 11*b* is formed by notching from the inside to the outside of the outer case 11 in each of the pair of guide grooves 11*a*. For example, as illustrated in FIG. 7, it is also possible to form, as the oil reservoir structure Z, corner portions on both sides in the peripheral direction of each of the pair of guide grooves 11*a* by rounding in an arc shape, and form the pair of discharge flow paths 11*b* between the cut portions 42*a* at both peripheral end portions of the external engagement arm 42 and the corner portions on both sides in the peripheral direction of the guide groove 11*a*. Even with such a configuration, it is possible to make it difficult for the lubricating oil supplied to the inside of the outer case 11 to be discharged, while having a lubricating function in the guide groove 11*a*.

Figure 8:
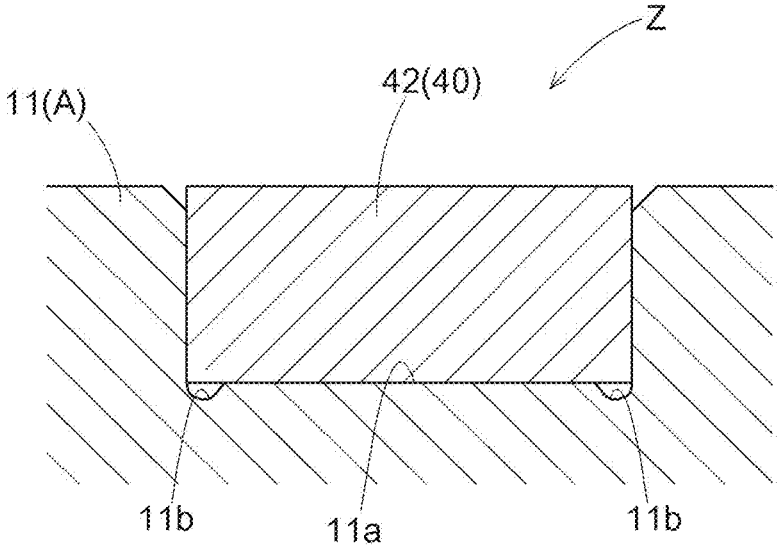
FIG. 8 is a view illustrating a discharge flow path according to another embodiment.

Furthermore, as the oil reservoir structure Z, the pair of discharge flow paths 11*b* can be provided individually at bottom portions of the pair of guide grooves 11*a* without providing the cut portions 42*a* at the both peripheral end portions of the external engagement arm 42, as illustrated in FIG. 8. Even in this case, it is possible to make it difficult for the lubricating oil supplied to the inside of the outer case 11 to be discharged, while having a lubricating function in the guide groove 11*a*.

In the embodiment described above, the description has been given assuming that the front plate 12 is opened up to the position of the inserted radially outer end portion in a state where the eccentric member 26 has the largest difference in the eccentric axis center Y with respect to the rotational axis center X, with the rotational axis center X as the center. However, the front plate 12 may be opened up to be larger over the position of the inserted radially outer end portion in a state where the eccentric member 26 has the largest difference in the eccentric axis center Y with respect to the rotational axis center X, with the rotational axis center X as the center.

[Outline of Embodiment Described Above]

Hereinafter, an outline of the valve open and close period control device 100 described above will be described.

(1) The valve open and close period control device 100 includes: the driving-side rotor A that rotates synchronously with the crankshaft 1 of the engine (internal combustion engine) E about the rotational axis center X; the driven-side rotor B that is disposed coaxially with the rotational axis center X on the inner side of the driving-side rotor A, and rotates integrally with the intake camshaft (camshaft) 2 for valve opening and closing of the engine E; and the phase adjustment mechanism C that sets a relative rotation phase between the driving-side rotor A and the driven-side rotor B. The phase adjustment mechanism C includes: the output gear 25 provided on the driven-side rotor B coaxially with the rotational axis center X; the input gear 30 that is connected to the driving-side rotor A and rotates about the eccentric axis center Y in an orientation parallel to the rotational axis center X; and the eccentric member 26 that has a tubular shape, supports the input gear 30 from an inner peripheral side via the second bearing (support bearing) 29, and rotates the input gear 30. The eccentric member 26 is configured to rotate to revolve the eccentric axis center Y to change a position of a meshing portion between the output gear 25 and the input gear 30, the driven-side rotor B has the support wall portion 21 connected to an end portion of the intake camshaft 2 in an orientation orthogonal to the rotational axis center X, the support wall portion 21 has the oil supply passage 21*a* through which lubricating oil can be supplied from an outside to an inside of the driven-side rotor B, and the driving-side rotor A has the front plate 12 on the side opposite to the intake camshaft 2 with respect to the eccentric member 26 in a direction along the rotational axis center X. The valve open and close period control device 100 has the oil reservoir structure Z that reduces a discharge amount of the lubricating oil discharged from an inside of the driving-side rotor A as compared to a supply amount of the lubricating oil supplied from the oil supply passage 21*a* to an inside of the driven-side rotor B, when the driving-side rotor A is rotating.

According to this configuration, when the driving-side rotor A is rotating, the lubricating oil supplied from the oil supply passage 21*a* to the inside of the driven-side rotor B can be made difficult to be discharged from the inside of the driving-side rotor A, so that oil (lubricating oil) can be stored in the driving-side rotor A. By storing the lubricating oil in the driving-side rotor A in this manner, it is possible to reduce loudness of sound caused by contact or collision of individual portions, with an oil damping effect. Therefore, noise and vibration generated from the valve open and close period control device 100 can be suppressed.

(2) The valve open and close period control device 100 according to (1) is preferably adapted such that the phase adjustment mechanism C further includes the Oldham's coupling Cx having the annular portion 41 and the pair of external engagement arms 42 protruding radially outward along a direction opposed to each other from the annular portion 41, the driving-side rotor A is formed with the pair of guide grooves 11*a* having a penetrating groove shape and extending radially outward along a direction opposed to each other from an inside to an outside of the driving-side rotor A at an opening edge portion with which the front plate 12 comes into contact, the pair of external engagement arms 42 are individually engaged with the pair of guide grooves 11*a*, each of the pair of guide grooves 11*a* has the discharge flow path 11*b* formed by notching from the inside to the outside of the driving-side rotor A, and the oil reservoir structure Z is configured to have a less oil amount of the lubricating oil discharged from the discharge flow path 11*b* than an oil amount of the lubricating oil flowing through the oil supply passage 21*a* when the driving-side rotor A is rotating.

In the phase adjustment mechanism C, in order to set a relative rotation phase between the driving-side rotor A and the driven-side rotor B, the external engagement arm 42 of the Oldham's coupling Cx included in the phase adjustment mechanism C is engaged with the guide groove 11*a* of the driving-side rotor A, and the lubricating oil is supplied to lubricate between the external engagement arm 42 and the guide groove 11*a*. However, since this guide groove 11*a* is provided in a penetrating groove shape from the inside to the outside of the driving-side rotor A, the lubricating oil supplied into the driving-side rotor A receives a centrifugal force due to the rotation of the driving-side rotor A and is discharged to the outside of the driving-side rotor A. Therefore, as described above, by making the flow amount of the lubricating oil flowing through the discharge flow path 11*b* formed in the guide groove 11*a* smaller than the flow amount of the lubricating oil flowing through the oil supply passage 21*a*, it is possible to easily store the lubricating oil in the driving-side rotor A.

(3) In the valve open and close period control device 100 described in (2), an oil amount of the lubricating oil discharged from the discharge flow path 11*b* is preferably made smaller than an oil amount obtained by subtracting an oil amount of the lubricating oil flowing inside the eccentric member 26 from an oil amount of the lubricating oil flowing through the oil supply passage 21*a*.

In this way, by making the oil amount of the lubricating oil discharged from the discharge flow path 11*b* to be smaller than the oil amount of the lubricating oil obtained by subtracting an oil amount of the lubricating oil flowing inside the eccentric member 26 from the oil amount of the lubricating oil flowing through the oil supply passage 21*a*, the lubricating oil can be easily stored in the driving-side rotor A.

(4) In the valve open and close period control device 100 described in (1), it is preferable that one side in an axial direction of the eccentric member 26 be inserted into an opening at a radially central portion of the front plate 12, and the front plate 12 be opened up to the position of the inserted radially outer end portion in a state where the eccentric member 26 has the largest difference in the eccentric axis center Y with respect to the rotational axis center X, with the rotational axis center X as the center.

According to such a configuration, when the engine E is in operation (when the valve open and close period control device 100 is driven and a centrifugal force acts on the lubricating oil), while ensuring a movable range of the eccentric member 26, it is possible to suppress discharge of the lubricating oil from between the eccentric member 26 and the opening, and to store the lubricating oil from an outer peripheral surface of the driving-side rotor A to the opening 12*a* at the radially central portion of the front plate 12. Whereas, when the engine E is stopped (when the valve open and close period control device 100 is not driven), the lubricating oil can be discharged from the opening 12*a* at the radially central portion of the front plate 12, so that deterioration of startability due to the lubricating oil can be prevented at the time of next starting the engine E.

(5) In the valve open and close period control device 100 according to (1), it is preferable that the second bearing 29 include a ball bearing having the inner ring 29*a* in contact with the outer peripheral surface of the eccentric member 26 and the outer ring 29*b* in contact with the inner peripheral surface of the input gear 30, one side in an axial direction of the eccentric member 26 be inserted into the opening 12*a* at the radially central portion of the front plate 12, and the second bearing 29 be covered with the front plate 12 as viewed in the rotational axis center X direction during rotation of the eccentric member 26.

With such a configuration, it is possible to suppress discharge of the lubricating oil from the ball bearing, and to store the lubricating oil in the oil reservoir structure Z.

(6) In the valve open and close period control device 100 according to (2), it is preferable that the oil reservoir structure Z be configured between a radially outer end portion of the discharge flow path 11*b* and the opening at the radially central portion of the front plate 12, and a meshing portion between the output gear 25 and the input gear 30, a sliding portion between the pair of external engagement arms 42 and the pair of guide grooves 11*a*, and the second bearing 29 be disposed in the oil reservoir structure Z.

With this configuration, the meshing portion between the output gear 25 and the input gear 30, the sliding portion between the pair of external engagement arms 42 and the pair of guide grooves 11*a*, and the second bearing 29 can be immersed in the lubricating oil. Therefore, the meshing portion between the output gear 25 and the input gear 30, the sliding portion between the pair of external engagement arms 42 and the pair of guide grooves 11*a*, and the second bearing 29 can move smoothly.

INDUSTRIAL APPLICABILITY

The present disclosure can be used in a valve open and close period control device.

REFERENCE SIGNS LIST

1: Crankshaft, 2: Intake camshaft (camshaft), 11*a*: Guide groove, 11*b*: Discharge flow path, 12: Front plate, 12*a*: Opening, 21: Support wall portion, 21*a*: Oil supply passage, 25: Output gear, 26: Eccentric member, 29: Second bearing (support bearing), 29*a*: Inner ring, 29*b*: Outer ring, 30: Input gear, 41: Annular portion, 42: External engagement arm, 100: Valve open and close period control device, A: Driving-side rotor, B: Driven-side rotor, C: Phase adjustment mechanism, Cx: Oldham's coupling, E: Engine (internal combustion engine), X: Rotational axis center, Y: Eccentric axis center, and Z: Oil reservoir structure.

The invention claimed is:

1. A valve open and close period control device comprising:

a driving-side rotor that rotates synchronously with a crankshaft of an internal combustion engine about a rotational axis center;

a driven-side rotor that is disposed coaxially with the rotational axis center on an inner side of the driving-side rotor, and rotates integrally with a camshaft for valve opening and closing of the internal combustion engine; and a phase adjustment mechanism that sets a relative rotation phase between the driving-side rotor and the driven-side rotor, wherein the phase adjustment mechanism includes:

an output gear provided on the driven-side rotor coaxially with the rotational axis center;

an input gear that is connected to the driving-side rotor and rotates about an eccentric axis center that is in an orientation parallel to the rotational axis center; and an eccentric member that has a tubular shape, supports the input gear from an inner peripheral side via a support bearing, and rotates the input gear, the eccentric member is configured to rotate to revolve the eccentric axis center to change a position of a meshing portion between the output gear and the input gear, the driven-side rotor has a support wall portion connected to an end portion of the camshaft, in an orientation orthogonal to the rotational axis center, and the support wall portion has an oil supply passage through which lubricating oil can be supplied from an outside of the driven-side rotor to an inside of the driven-side rotor, the driving-side rotor has a front plate on a side opposite to the camshaft with respect to the eccentric member, in a direction along the rotational axis center, and the valve open and close period control device has an oil reservoir structure that reduces a discharge amount of the lubricating oil discharged from an inside of the driving-side rotor, as compared to a supply amount of the lubricating oil supplied from the oil supply passage to the inside of the driven-side rotor when the driving-side rotor is rotating, wherein the lubricating oil is discharged to the outside of the driving-side rotor through a gap between the front plate and the driving-side rotor, and an amount of the lubricating oil discharged to the outside of the driving-side rotor through the gap between the front plate and the driving-side rotor is smaller than a sum of an amount of the lubricating oil passing through a meshing portion between the input gear and the driven-side rotor and an amount of the lubricating oil passing through the support bearing.

2. The valve open and close period control device according to claim 1, wherein the phase adjustment mechanism further includes an Oldham's coupling having an annular portion and a pair of external engagement arms protruding radially outward from the annular portion along a direction in which the pair of external engagement arms are opposed to each other, the driving-side rotor is formed with a pair of guide grooves having a penetrating groove shape and extending radially outward along a direction in which the pair of guide grooves are opposed to each other from the inside of the driving-side rotor to an outside of the driving-side rotor, at an opening edge portion with which the front plate comes into contact, the pair of external engagement arms are individually engaged with the pair of guide grooves, each of the pair of guide grooves has a discharge flow path formed by notching from the inside of the driving-side rotor to the outside of the driving-side rotor, and the oil reservoir structure is configured to have a less oil amount of the lubricating oil discharged from the discharge flow path than an oil amount of the lubricating oil flowing through the oil supply passage when the driving-side rotor is rotating.

3. The valve open and close period control device according to claim 2, wherein an oil amount of the lubricating oil discharged from the discharge flow path is made smaller than an oil amount obtained by subtracting an oil amount of the lubricating oil flowing inside the eccentric member from an oil amount of the lubricating oil flowing through the oil supply passage.

4. The valve open and close period control device according to claim 2, wherein the oil reservoir structure is configured between a radially outer end portion of the discharge flow path and an opening at a radially central portion of the front plate, and the meshing portion between the output gear and the input gear, a sliding portion between the pair of external engagement arms and the pair of guide grooves, and the support bearing are disposed in the oil reservoir structure.

5. The valve open and close period control device according to claim 1, wherein one side of the eccentric member in an axial direction of the eccentric member is inserted into an opening at a radially central portion of the front plate, and the front plate is opened up to a position of a radially outer end portion of the inserted eccentric member in a state where the eccentric member has a largest difference in the eccentric axis center with respect to the rotational axis center, with the rotational axis center as a center.

6. The valve open and close period control device according to claim 1, wherein the support bearing includes a ball bearing having an inner ring in contact with an outer peripheral surface of the eccentric member and an outer ring in contact with an inner peripheral surface of the input gear, and one side of the eccentric member in an axial direction of the eccentric member is inserted into an opening at a radially central portion of the front plate, and the support bearing is covered with the front plate as viewed in a direction of the rotational axis center during rotation of the eccentric member.

7. A valve open and close period control device comprising:

a driving-side rotor that rotates synchronously with a crankshaft of an internal combustion engine about a rotational axis center;

a driven-side rotor that is disposed coaxially with the rotational axis center on an inner side of the driving-side rotor, and rotates integrally with a camshaft for valve opening and closing of the internal combustion engine; and a phase adjustment mechanism that sets a relative rotation phase between the driving-side rotor and the driven-side rotor, wherein the phase adjustment mechanism includes:

an output gear provided on the driven-side rotor coaxially with the rotational axis center;

an input gear that is connected to the driving-side rotor and rotates about an eccentric axis center that is in an orientation parallel to the rotational axis center; and an eccentric member that has a tubular shape, supports the input gear from an inner peripheral side via a support bearing, and rotates the input gear, the eccentric member is configured to rotate to revolve the eccentric axis center to change a position of a meshing portion between the output gear and the input gear, the driven-side rotor has a support wall portion connected to an end portion of the camshaft, in an orientation orthogonal to the rotational axis center, and the support wall portion has an oil supply passage through which lubricating oil can be supplied from an outside of the driven-side rotor to an inside of the driven-side rotor, the driving-side rotor has a front plate on a side opposite to the camshaft with respect to the eccentric member, in a direction along the rotational axis center, and the valve open and close period control device has an oil reservoir structure that reduces a discharge amount of the lubricating oil discharged from an inside of the driving-side rotor, as compared to a supply amount of the lubricating oil supplied from the oil supply passage to the inside of the driven-side rotor when the driving-side rotor is rotating, wherein the phase adjustment mechanism further includes an Oldham's coupling having an annular portion and a pair of external engagement arms protruding radially outward from the annular portion along a direction in which the pair of external engagement arms are opposed to each other, the driving-side rotor is formed with a pair of guide grooves having a penetrating groove shape and extending radially outward along a direction in which the pair of guide grooves are opposed to each other from the inside of the driving-side rotor to an outside of the driving-side rotor, at an opening edge portion with which the front plate comes into contact, the pair of external engagement arms are individually engaged with the pair of guide grooves, each of the pair of guide grooves has a discharge flow path formed by notching from the inside of the driving-side rotor to the outside of the driving-side rotor, and the oil reservoir structure is configured to have a less oil amount of the lubricating oil discharged from the discharge flow path than an oil amount of the lubricating oil flowing through the oil supply passage when the driving-side rotor is rotating.

8. The valve open and close period control device according to claim 7, wherein an oil amount of the lubricating oil discharged from the discharge flow path is made smaller than an oil amount obtained by subtracting an oil amount of the lubricating oil flowing inside the eccentric member from an oil amount of the lubricating oil flowing through the oil supply passage.

9. The valve open and close period control device according to claim 7, wherein the oil reservoir structure is configured between a radially outer end portion of the discharge flow path and an opening at a radially central portion of the front plate, and the meshing portion between the output gear and the input gear, a sliding portion between the pair of external engagement arms and the pair of guide grooves, and the support bearing are disposed in the oil reservoir structure.

* * * * *